United States Patent [19]

Fredette

[11] Patent Number: 4,608,800

[45] Date of Patent: Sep. 2, 1986

[54] CORNER PIECE FOR VINYL SIDING RETAINERS

[76] Inventor: Richard Fredette, P.O. Box 31921, Lafayette, La. 70503

[21] Appl. No.: 683,352

[22] Filed: Dec. 19, 1984

[51] Int. Cl.[4] ..... E06B 1/26

[52] U.S. Cl. ..... 52/656; 52/211; 52/288; 52/278; 52/476

[58] Field of Search ..... 52/656, 211, 204, 212, 52/475, 476, 288, 278, 716; 403/401–403, 405, 295, 341

[56] References Cited

U.S. PATENT DOCUMENTS

| | | | |
|---|---|---|---|
| 2,663,390 | 12/1953 | Dordel | 52/211 |
| 3,103,710 | 9/1963 | Fredricksen | 52/211 |
| 3,500,600 | 3/1970 | Bagley | 52/211 |
| 4,018,260 | 4/1977 | Baslow | 52/288 X |
| 4,228,630 | 10/1980 | Englert et al. | 52/211 |

*Primary Examiner*—J. Karl Bell

*Attorney, Agent, or Firm*—Keaty & Keaty

[57] ABSTRACT

A significant drawback in prior art methods of fastening vinyl siding to the exterior of houses is the objectionable appearance of the junction between horizontal and vertical retaining strips around right angle openings (windows and doors) in the walls being covered. Typically, these channel shaped retaining strips are butted up against one another at the corners. Gaps and rough edges resulting from the cutting and fitting of these pieces are quite visually objectionable. Applicant's invention comprises a corner piece which is firmly attached to the wall at the juncture of the horizontal and vertical retainer strips and covers the juncture between the horizontal and vertical retainer strips. This corner piece comprises a generally L-shaped base plate and integrally formed first and second flange means extending outward and parallel thereto to provide a continuous L-shaped barrier that forms a channel which cooperates with and contains the ends of the vertical and horizontal retainer strips adjacent the corner of the opening.

6 Claims, 4 Drawing Figures

CORNER PIECE FOR VINYL SIDING RETAINERS

BACKGROUND OF THE INVENTION

1. Field of the Invention

This invention concerns siding for covering the walls of structures. More particularly, it relates a corner piece for covering the junctions between horizontal and vertical retainer strips which retain siding around right-angled openings.

2. General Background of the Invention of structures such as houses. Such siding has often been made of aluminum, but recently vinyl siding has been developed.

The siding is attached to the exterior wall of a structure by affixing a pair of parallel retaining strips to the exterior wall. These retaining strips contain longitudinal slots in which hooks carried by the back face of the siding are placed.

A significant drawback in the prior art concerns the aesthetically objectionable appearance of the junction between horizontal and vertical retaining strips around right-angled openings such as doors and windows. These right-angle openings have horizontal and vertical frame components, and the retaining strips are placed adjacent these frame components. The retainers are channel-shaped, and are comprised of a flat base which is attached to the wall, and an outwardly projecting L-shaped member that provides a channel into which the siding is placed. The junction between the horizontal and vertical strips creates a visible separation which detracts from the appearance of the siding. The junction between the strips can become even more noticeable as temperatures change and causes the siding to expand or contract.

It is accordingly an object of this invention to provide a corner piece for covering junctions between adjacent horizontal and vertical retainer strips which retain siding around right-angled openings in exterior walls.

It is a further object of the invention to provide a retainer which permits the strips to expand and contract in response to changing environmental temperatures without affecting the outward appearance of the corner piece.

SUMMARY OF THE INVENTION

The foregoing objects are achieved by providing a corner piece for covering the junctions between adjacent horizontal and vertical retainer strips. The corner piece comprises a generally L-shaped base plate having a first leg integral with the second leg, the first leg being defined by an inner and an outer edge, the second leg also being defined by an inner and an outer edge. A first and a second flange extend outwardly from the plate continuously along the inner edges of the first and second legs, the flanges being comprised of first and second members. The first member is perpendicular to the plate, while the second member is held in spaced, substantially parallel relationship to the base plate by the first member. The second members thereby present a continuous, L-shaped barrier that forms a channel in cooperation with the base plate and first member.

The corner piece is placed at the corner of a door or window around which siding is being placed. A first retainer strip is placed adjacent the horizontal frame component along substantially its entire length with the channel of the first strip being placed within the channel of a first leg of the base plate. A second retaining strip is placed adjacent the vertical frame component along substantially the entire length of the vertical frame component with the channel of the second strip being received within the channel of a second leg of the base plate. In this manner, the visible junction between horizontal and vertical retainer strips is obscured.

DETAILED DESCRIPTION OF THE PREFERRED EMBODIMENT

Figure 4:
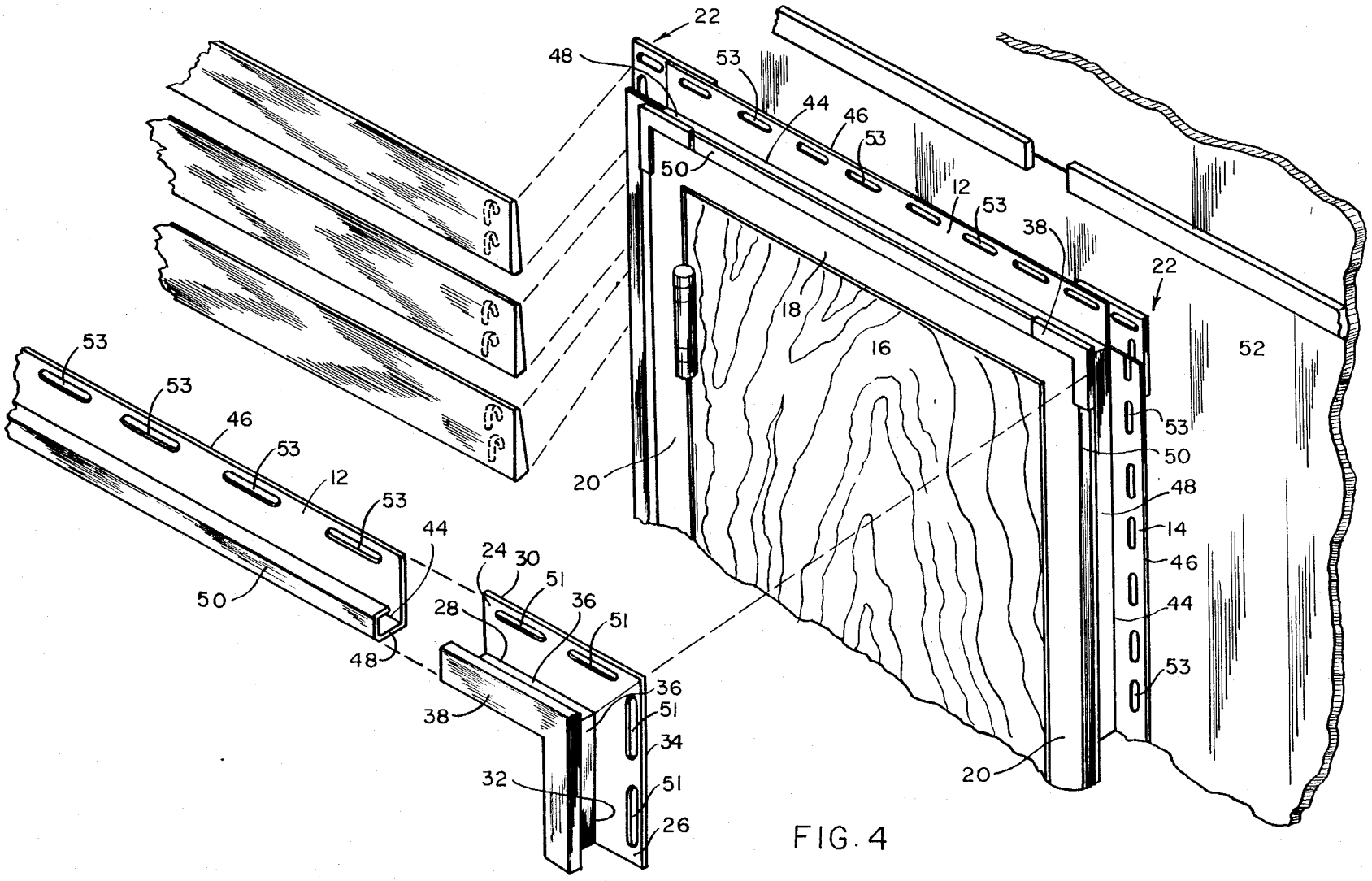
FIG. 4 is a perspective, fragmentary view of the corner piece covering the junction between adjacent horizontal and vertical retainer strips, the horizontal retainer strip and cornerpiece being shown in the foreground unattached to the wall.

Turning now to the drawings, a vinyl corner piece 10 is shown for covering junctions between adjacent horizontal retainer strip 12 and vertical retainer strip 14 (FIG. 4). Retainer strips 12, 14 are of the kind known in the art for retaining siding around right-angled openings such as door 16 having a horizontal frame component 18 and a vertical frame component 20. Corner piece 10 comprises a generally L-shaped vinyl base plate 22 having a first leg 24 integral with a second leg 26. First leg 24 is defined by an inner edge 28 and an outer edge 30. Second leg 26 is also defined by an inner edge 32 and an outer edge 34.

A first and a second vinyl flange extend outwardly from base plate 22 continuously along inner edges 28, 32 of first and second legs 24, 26. Each flange is comprised of a first member 36 and a second member 38. First member 36 is formed integral with second member 38, the first member 36 being perpendicular to base plate 22. Second member 38 is held in space, substantially parallel relationship to base plate 22 by first member 36, the second member 38 presenting a continuously, L-shaped barrier that forms a channel in cooperation with base plate 22 and first member 36.

Figure 1:
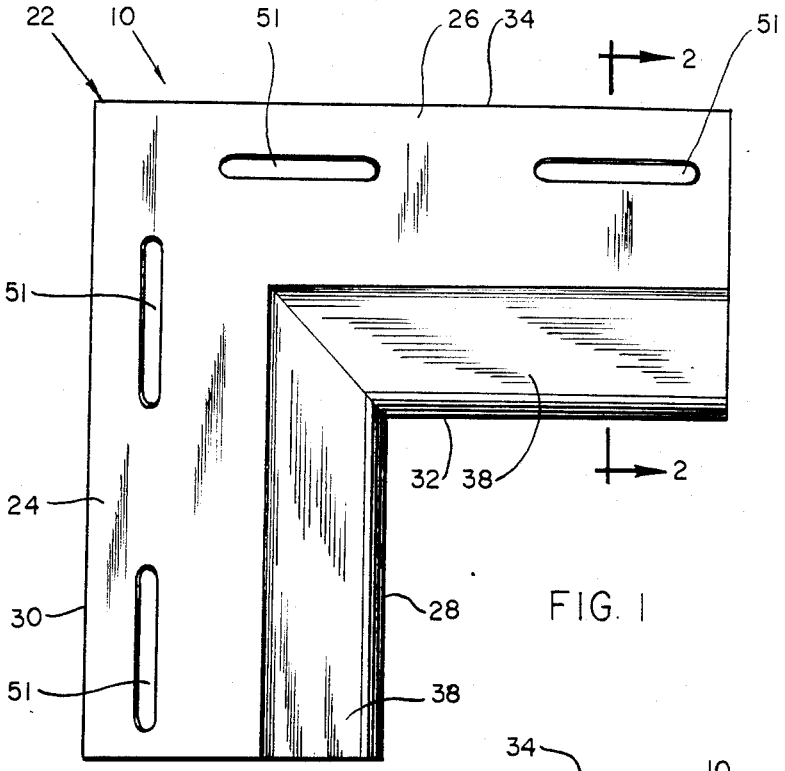
FIG. 1 is a plan view of the corner piece for covering junctions between adjacent horizontal and vertical retainer strips.
Figure 2:
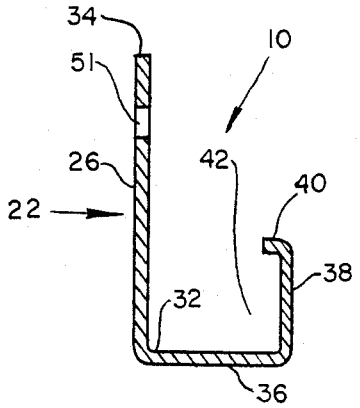
FIG. 2 is a cross-sectional view taken along section lines 2—2 in FIG. 1.
Figure 3:
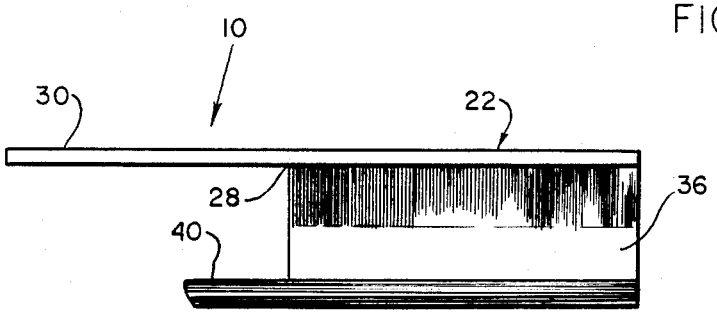
FIG. 3 is a side view of the corner piece shown in FIG. 1, the view being taken into the channel of the corner piece.

A continuous vinyl retainer lip flange 40 is integral with and carried by each second member 38 and projects from second member 38 towards base plate 22 in at least partially covering relationship to channel 42 (FIG. 2). In the embodiment shown in the drawings, retainer flange 40 is an arcuate member which is in covering relationship to only a portion of channel 42 and substantially parallel to first member 36 or 38 that it covers. The purpose of retainer flange 40 is to press siding into close relationship with base plate 22.

Retaining strips 12, 14 are each defined by a first edge 44 and second edge 46, the strips preferably being made of vinyl or other material similar to the siding. An L-shaped extension projects outwardly from each strip 12, 14 along first edge 44 of strip 12, 14. The extension is comprised of first element 48 and second element 50, the elements being integral with strip 12, 14. First element 48 is substantially perpendicular to the strip 12, 14, the second element 50 being held in spaced, parallel relationship to strip 12 or 14 by first element 48. The perpendicular distance between second element 50 and strip 12 or 14 is less than the perpendicular distance between second member 38 of corner piece 10 and its base plate 22, the channel formed by retainer strips 12, 14 thereby being slightly narrower than the channel formed in corner piece 10. Second element 50 of strips 12, 14 each present a continuous barrier that forms a channel in cooperation with strip 12 or 14 and first element 48.

In operation, the generally L-shaped base plate 22 is secured adjacent a corner formed by the intersection of horizontal and vertical components 18, 20 of the frame for door 16. Base plate 22 is secured to the corner by driving a nail, screw or other suitable fastener through the base plate and adjoining wall. In the embodiment shown in the drawings, slots 51 are provided in cornerpiece 10 through which fasteners may be placed. First leg 24 is placed adjacent and parallel to horizontal component 18 of the door frame while second leg 26 is placed adjacent and parallel to the vertical component 14 of the frame. After being so fastened to the wall, base plate 22 is parallel to exterior wall 52 of the structure being covered, while first member 36 projects perpendicularly outwardly away from wall 52 flush with the frame component in which it is adjacent. Second member 38 thereby presents a continuous, L-shaped barrier parallel to base plate 22 around the corner.

Horizontal retainer strip 12 is fixed adjacent horizontal frame component 88 along substantially the entire length of horizontal frame component 18. First strip 48 is fastened flat against wall 52 with its channel resting along the length of horizontal frame component 18. First element thereby projects perpendicularly outwardly from wall 52 while second element 50 provides a continuous barrier which, in cooperation with the element 48 and strip 12 creates a channel into which siding panels may be received. Fasteners can be placed through slots 53. Since the channel of strip 12 is narrower than the channel of first leg 24, the channel of strip 12 is received within the channel of the first leg of the base plate. In preferred embodiments, the channel of strip 12 is only slightly less than the width of the channel in the corner piece, thereby providing a sliding yet tight fit between strip 12 and the channel of first leg 24.

Second strip 14 is affixed to wall 52 adjacent vertical frame component 20 along substantially the entire length of the vertical frame component by fixing fasteners through openings 53. Strip 14 is flush with the vertical frame component in much the same fashion as described above with the horizontal frame component 18. The channel of the second, vertical strip is once again only slightly smaller than the channel of second leg 26 so that the channel of second, vertical strip 14 is received within the channel of second leg 26 of corner piece 10.

Although a preferred embodiment of the invention has been disclosed in accordance with requirements of law, the scope of the invention is at least as broad as the following claims.

I claim:

1. A corner piece for covering junctions between adjacent horizontal and vertical retainer strips which retain siding to a wall around right angled openings in said wall, said openings having horizontal and vertical frame components, the corner piece comprising:

a generally L-shaped base plate for fastening to said wall having a first leg integral with a second leg, the first leg being defined by an inner and an outer edge, the second leg being defined by an inner and an outer edge; and a first and a second flange extending outwardly from said base plate and said wall when said base plate is fastened to said wall, said first and second flange extending continuously along the inner edges of the first and second legs, each said first and second flange being comprised of first and second members, the first member being perpendicular to the base plate, the second member being held in spaced, substantially parallel relationship to the plate by the first member, the second members presenting a continuous, L-shaped barrier that forms a channel in cooperation with the base plate and first member.

2. The corner piece of claim 1 further comprising a continuous, retainer flange carried by each second member and projecting from the second member towards the base plate in partially covering relationship to the channel.

3. The corner piece of claim 2 wherein the base is provided with openings through which fasteners can be placed to secure the base to a wall.

4. The corner piece of claim 2 wherein the corner piece is vinyl.

5. A vinyl corner piece for covering junctions between adjacent horizontal and vertical retainer strips for siding around right angled openings in a wall, said openings having horizontal and vertical frame components, the corner piece comprising:

a generally L-shaped vinyl base plate for fastening to said wall having a first leg integral with a second leg, the first leg being defined by an inner and an outer edge, the second leg being defined by an inner and an outer edge; and a first and a second vinyl flange extending outwardly from said base plate and said wall when said base plate is fastened to said wall, said first and second vinyl flange extending continuously along the inner edges of the first and second legs, the flanges each being comprised of first and second members, the first member being perpendicular to the base plate, the second member being held in spaced, substantially parallel relationship to the base plate by the first member, the second members presenting a continuous, L-shaped barrier that forms a channel in cooperation with the base plate and first member;

a continuous vinyl retainer flange carried by each second member and projecting from the second member towards the base plate in partially covering relationship to the channel.

6. A method for covering the junction between elongated horizontal and vertical retainer strips around right angled openings in a wall, said openings having adjacent horizontal and vertical frame components, the method comprising the steps of:

securing a generally L-shaped base plate to said wall adjacent a corner formed by the intersection of the horizontal and vertical components of the frame, the base plate having a first leg integral with a second leg, the first leg being defined by an inner and an outer edge, the second leg being defined by an inner and an outer edge, a first and a second flange extending outwardly from the plate and from said wall continuously along the inner edges of the first and second legs, each said first and second flange being comprised of first and second members, the first member being perpendicular to the base plate, the second member being held in spaced, substantially parallel relationship to the plate by the first member, the second members presenting a continuous, L-shaped barrier that forms a channel in cooperation with the base plate and first member, the first leg being placed adjacent and parallel to the horizontal component of the frame and the second leg being placed adjacent and parallel to the vertical component of the frame;

providing a first and a second strip, each strip being defined by a first edge and a second edge, an L-shaped extension projecting outwardly from the strip continuously along the first edge of the strip, the extension being comprised of first and second elements, the first element being substantially perpendicular to the strip, the second element being held in spaced, parallel relationship to the strip by the first element, the distance between the second element and the strip being less than the distance between the second member of the base plate and the base plate, the second element presenting a continuous barrier that forms a channel in cooperation with the strip and first element;

affixing the first strip adjacent the horizontal frame component along substantially the entire length of the horizontal frame component with the channel of the first strip being received within the channel of the first leg of the base plate;

affixing the second strip adjacent the vertical frame component along substantially the entire length of the vertical frame component, the channel of the second strip being received within the channel of the second leg of the base plate.

* * * * *